US010548396B1

(12) United States Patent
Hong

(10) Patent No.: US 10,548,396 B1
(45) Date of Patent: Feb. 4, 2020

(54) SLIDE DEVICE FOR MOVABLE RACK

(71) Applicant: JEON HAN SLIDE CO., LTD., Chungcheongbuk-do (KR)

(72) Inventor: Jang Sun Hong, Seoul (KR)

(73) Assignee: JEON HAN SLIDE CO., LTD., Eumseong-Gun, Chungcheongbuk-Do (KR)

( * ) Notice: Subject to any disclaimer, the term of this patent is extended or adjusted under 35 U.S.C. 154(b) by 0 days.

(21) Appl. No.: 16/161,316

(22) Filed: Oct. 16, 2018

(30) Foreign Application Priority Data

Sep. 10, 2018 (KR) ..... 10-2018-0107723

(51) Int. Cl.
*A47B 46/00* (2006.01)
*A47B 96/02* (2006.01)

(52) U.S. Cl.
CPC ..... *A47B 46/005* (2013.01); *A47B 96/025* (2013.01)

(58) Field of Classification Search
CPC ..... A47B 46/005; A47B 96/025; A47B 55/02; F24C 15/168; F24C 15/16; A47L 15/507
USPC ..... 126/339, 337 A, 337 R; 312/410, 408, 312/334.44, 222
See application file for complete search history.

(56) References Cited

U.S. PATENT DOCUMENTS 1,872,733 A * 8/1932 Greenwald ..... F24C 15/16 126/337 R
1,946,532 A * 2/1934 Hatch ..... F24C 15/16 108/143
2,015,389 A * 9/1935 Whitted ..... F25D 25/024 108/143
3,019,071 A * 1/1962 Davis ..... F25D 25/024 312/308
5,251,973 A * 10/1993 Hazan ..... A47B 61/00 211/186

(Continued)

FOREIGN PATENT DOCUMENTS

KR 10-2010-0084384 A 7/2010
KR 10-1561653 B1 10/2015

*Primary Examiner* — Patrick D Hawn
(74) *Attorney, Agent, or Firm* — Novick, Kim & Lee, PLLC; Jae Youn Kim

(57) ABSTRACT

Provided is a slide device for a movable rack including: a mounting rack to be removably positioned at anyone of a plurality of mounting rail grooves formed in a storage space of a machine body and to support a movable to be pulled/pushed in both a forward/backward direction; a movable rack to be pulled/pushed in the forward/backward direction by a sliding motion on the mounting rack, to load/unload articles; a locking unit positioned in the rear inside the mounting rack, to fix the mounting rack to prevent the mounting rack from moving when the movable rack is pulled out from the mounting rack, wherein the locking unit includes: a locking member including a front to be connected to the mounting rack by a hinge and to pivot upwardly, a rear lower end with a locking groove and a middle lower part with an inclined operation piece; and a spring positioned between the locking member and the mounting rack, to elastically support the locking member; and a contact cap to receive the inclined operation piece of the locking member, to reduce in use any operation noise generated when the movable rack hits the locking member when the movable rack is pushed into the mounting rack.

2 Claims, 9 Drawing Sheets

(56) References Cited

U.S. PATENT DOCUMENTS 6,148,813 A * 11/2000 Barnes ..... F24C 15/168 108/143
6,789,861 B1 * 9/2004 Dobberstein ..... A21B 3/155 312/330.1
6,938,617 B2 * 9/2005 Le ..... F24C 15/16 126/273 R
7,087,862 B1 * 8/2006 Shaffer ..... F24C 15/168 126/333
7,216,646 B2 * 5/2007 Le ..... F24C 15/16 126/273 R
7,942,486 B2 * 5/2011 Petri ..... F24C 15/16 312/333
8,047,199 B2 * 11/2011 Le ..... F24C 15/16 126/337 R
8,490,801 B2 * 7/2013 Smith ..... F24C 15/16 126/339
8,646,444 B2 * 2/2014 Williams ..... F24C 15/168 126/332
8,820,314 B1 * 9/2014 Johnson ..... F24C 15/16 126/332
9,022,496 B2 * 5/2015 Armstrong ..... F24C 15/16 312/319.3
9,297,539 B2 * 3/2016 Ambrose ..... F24C 15/16
9,408,462 B1 * 8/2016 Hong ..... A47L 15/507
9,587,838 B2 * 3/2017 Stewart ..... F24C 15/168
9,671,115 B2 * 6/2017 Elkasevic ..... F24C 15/168
9,920,935 B2 * 3/2018 Stewart ..... F24C 15/168
2009/0064707 A1 * 3/2009 Smith ..... F25D 11/006 62/465
2010/0018517 A1 * 1/2010 Chen ..... F24C 15/16 126/337 R
2010/0218755 A1 * 9/2010 Stewart ..... F24C 15/168 126/339
2017/0146246 A1 * 5/2017 Stewart ..... F24C 15/168

* cited by examiner

SLIDE DEVICE FOR MOVABLE RACK

CROSS-REFERENCE TO RELATED APPLICATION

This application claims the priority of Korean Patent Application No. 10-2018-0107723, filed on Sep. 10, 2018, the disclosure of which is hereby incorporated herein by reference in its entirety.

BACKGROUND OF THE INVENTION

1. Field of the Invention

The present invention relates to a slide device for a movable rack and more particularly, to a slide device for a movable rack which glides in both a forward/backward direction from a mounting rack which is installed to be drawn out inside a machine body (such as a dishwasher, oven, storage or the like), to reduce the impact and noise when the movable rack is pushed back into the mounting rack.

2. Description of the Related Art

Generally, a home appliance or industrial machine, such as a dish washer or oven, etc., includes a mounting rack and a movable rack to load the articles, such as dishes to be washed or foods to be cooked, or to unload articles, such as the washed dishes or cooked foods.

The mounting rack, which is installed to be drawn out inside the machine body, is usually placed on mounting rail grooves formed on both sides in a cavity forming a washing space or cooking space of the machine.

When a plurality of the mounting rail grooves are formed along the both sides of the cavity, the position to place the mounting rack is variable.

That is, when a plurality of the mounting rail grooves is formed along both sides of the cavity, a user can change the position of the mounting rack by fully taking it out to the outside of the cavity and placing it in different mounting rail grooves.

However, when the mounting rack is placed in the same position and a movable rack is installed on the mounting rack so as to slide in a forward/backward direction, the user can load or unload articles by pulling out only the movable rack in the forward direction of the cavity, without any need to separate the mounting rack from the cavity, such that the mounting rack stays inside the machine body.

The present invention relates to a slide device for a movable rack which slides in both a forward/backward direction on the mounting rack which can be drawn out from a machine body.

Patent Document 1 discloses a rack assembly and an oven having the same.

The rack assembly according to Patent Document 1 comprises: a mounting rack to be mounted inside an oven cavity; a movable rack to slide on the mounting rack and be pulled out/pushed into the oven cavity; a rail allowing the movable rack to slide on the mounting rack; a support rib enabling the mounting rack to be positioned at a predetermined height inside the oven cavity; and a movement preventing rib preventing the mounting rack from moving in the forward direction of the oven cavity at least when the movable rack slides.

The rack assembly according to Patent Document 1 is removed from the oven cavity and the movable rack where articles are loaded is drawn from the mounting rack supported in the oven cavity.

In the slide devices for a movable rack according to the conventional art including the rack assembly of Patent Document 1, a supporting bar and a securing bar are installed in a mounting rack and a movable rack. A rail section includes a first rail, a second rail and a third rail and the first rail is secured to the supporting bar and the second rail is secured to the securing bar. Therefore, since many parts are required and manufacturing is cumbersome, production costs are high.

Further, in the slide device for a movable rack according to the conventional art, when the movable rack and the securing bar are drawn out to the outside of the cavity, since the supporting bar and the mounting rack move by the inertia force, pulling out the movable rack is not smooth.

Further, in the slide device for a movable rack according to the conventional art, the movable rack has a pair of fixing brackets, a holding grate is positioned between the two fixing brackets, and a moving rail member to be connected to a fixing rail member of the mounting rack is positioned at each bracket. Therefore, it is cumbersome to manufacture the movable rack and further since the movable rack is heavy, it makes uneasy to be handled.

Accordingly, the applicant of the present invention has presented a slide device for a movable rack which prevents the movement of the mounting rack when the movable rack is pulled out from the mounting rack installed in the storage space of a machine body and which is movable on the mounting rack in both a forward/backward direction, to be easily manufactured and handled and therefore to improve productivity and enabling cost reduction.

Patent Document 2, which is an application filed by the present applicant, discloses a slide device for a movable rack.

The slide device for a movable rack according to Patent Document 2 comprises: a machine body defining a storage space with an open front and both sides where a plurality of mounting rail grooves are formed; a mounting rack removably positioned at any one of the mounting rail grooves formed in the storage space of the machine body; a movable rack positioned to slide on the mounting rack in a forward/backward direction; and a locking unit to secure the mounting rack to the machine body so that the mounting rack is prevented from being movable when the movable rack is drawn on the mounting rack. The locking unit includes a locking member; a spring and a locking bracket. The locking member has a front to be connected to a fixing rail member by a hinge such that the locking unit is pivotable vertically, and a locking groove formed at a lower end. The spring is positioned between the locking member and the fixing rail member, to elastically support the locking member. The locking brackets are positioned at the rears of both sides defining the storage space of the machine body and includes a plurality of locking pieces which are provided vertically.

FIG. 1 is a perspective view of major parts of a slide device for a movable rack according to the prior art filed by the applicant of the present invention, FIG. 2 is a perspective view of a mounting rack and a movable rack of FIG. 1, FIG. 3A is a side view of major parts when the movable rack is pushed in the mounting rack according to the prior art, and FIG. 3B is a side view of the major parts when the movable rack is drawn from the mounting rack according to the prior art.

In a slide device 500 for a movable rack according to the prior art filed by the present applicant, when a movable rack 530 is placed on a mounting rack 520 installed in a storage space (S) of a machine body 510, as shown in FIG. 3A, since a moving rail member 531 fixed to the movable rack 530 supports a locking member 541 of a locking unit 540, the locking member 541 is maintained in an upwardly pivoted state. Accordingly, the mounting rack 520 is pushed inside the storage space (S) or pulled out to the outside of the storage space (S).

When only the movable rack 530 is pulled out forwardly from the mounting rack 520 in the state that the mounting rack 520 is installed in the storage space (S), the moving rail member 531 is pulled out forwardly and a rear of the locking member 541 downwardly pivots through the elasticity of a spring 542. Accordingly, as shown in FIG. 3B, a locking groove 541*a* of the locking member 541 is connected to a locking piece 543*a* of a locking bracket 543 and the mounting rack 520 is locked and prevented from moving.

When the movable rack 530 is pushed backwardly to be placed on the mounting rack 520 in the state that the mounting rack 520 is locked, the moving rail member 531 pushes up a lower end of the locking member 541 so that the locking member 541 pivots upwardly. Accordingly, the locking groove 541*a* of the locking member 541 is separated from the locking piece 543*a* of the locking bracket 543 and the mounting rack 520 is unlocked so that the mounting rack 520 and the movable rack 530 are pulled out from the storage space (S) of the machine body 510.

According to the slide device 500, when the movable rack 530 is pulled out from the storage space (S) of the machine body 510, the mounting rack 520 is locked. When the movable rack 530 is pushed in, the mounting rack 520 is unlocked so that the mounting rack 520 and the movable rack 530 are pulled from the storage space (S) of the machine body 510.

RELATED ART DOCUMENT

Patent Document

Patent Document 1. Korean Patent Application Publication No. 10-2010-0084384 (Jul. 26, 2010)

Patent Document 2. Korean Patent Publication No. 10-1561653 (Oct. 13, 2015)

SUMMARY OF THE INVENTION

In the slide device 500 for a movable rack according to the application filed earlier by the present applicant, when the movable rack 530 pulled out to the outside is pushed to be placed on the mounting rack 520 and the locking state of the movable rack 530 is released, the rear of the moving rail member 531 hits the locking member 541, causing a heavy operational noise to lower the marketability of the slide device for the movable rack and the machine using the slide device.

Therefore, it is an object of the present invention to solve the above problems and to provide a slide device for a movable rack which reduces the operational noise caused by an impact of a moving rail member and a locking member during the process of releasing a locking state of a mounting rack when the movable rack pulled out to the outside is pushed into the mounting rack.

In accordance with an embodiment of the present invention, there is provided a slide device for a movable rack, comprising: a mounting rack to be removably positioned at anyone of a plurality of mounting rail grooves formed in a storage space of a machine body and to support a movable to be pulled/pushed in both a forward/backward direction; a movable rack to be pulled/pushed in the forward/backward direction by a sliding motion on the mounting rack, to load/unload articles; a locking unit positioned in the rear inside the mounting rack, to fix the mounting rack to prevent the mounting rack from moving when the movable rack is pulled out from the mounting rack, wherein the locking unit comprises: a locking member including a front to be connected to the mounting rack by a hinge and to pivot upwardly, a rear lower end with a locking groove and a middle lower part with an inclined operation piece; and a spring positioned between the locking member and the mounting rack, to elastically support the locking member; and a contact cap to receive the inclined operation piece of the locking member, to reduce in use any operation noise generated when the movable rack hits the locking member when the movable rack is pushed into the mounting rack.

The mounting rack comprises: a pair of mounting brackets to be positioned at the mounting rail grooves in the storage space, to be movable in the forward/backward direction; a fixing rail member to be fixed inside each of the mounting brackets; and a plurality of mounting grates positioned between the pair of the mounting brackets. The movable rack comprises: a pair of glide brackets; a moving rail member to be fixed to the outside of each of the glide brackets and each of the moving rail members of the movable rack is connected to the fixing rail member of the mounting rack through a middle rail member, to slide in the forward/backward direction; and a plurality of glide grates positioned between the pair of the moving rail members.

The contact cap comprises: a cover part with an insertion hole; a contact part extending at a side of a lower end of the cover part; and a curved surface formed at an inner side of the lower end, to enable a smooth contact with the glide brackets.

According to the slide device for a movable rack of the present invention, since the contact noise of the movable rack and the locking member is reduced when the mounting rack is unlocked as the movable rack pulled out to the outside is pushed in the mounting rack, the marketability of the slide device for the movable rack and a machine using the slide device is greatly improved.

BRIEF DESCRIPTION OF THE DRAWINGS

The above and other features and advantages of the present invention will become more apparent to those of ordinary skill in the art by describing in detail the preferred embodiment(s) thereof with reference to the attached drawings in which:

FIG. 3A is a side view of major parts when the mounting rack of FIG. 1 is pushed in;

DESCRIPTION OF NUMBERS FOR CONSTITUENTS IN DRAWINGS

Figure 1:
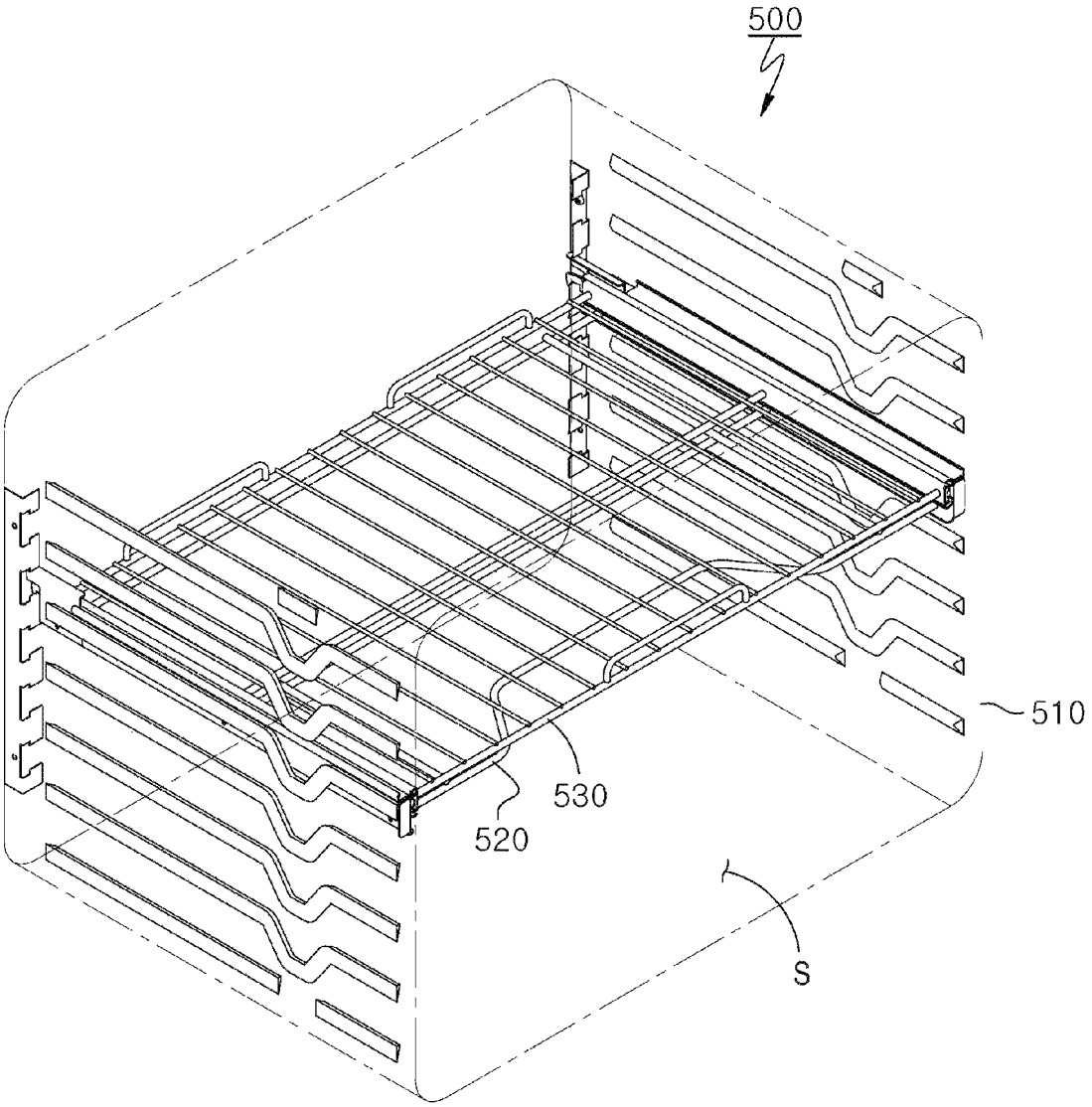
FIG. 1 is a perspective view of major parts of a slide device for a movable rack according to the prior art filed by the applicant of the present invention.
Figure 2:
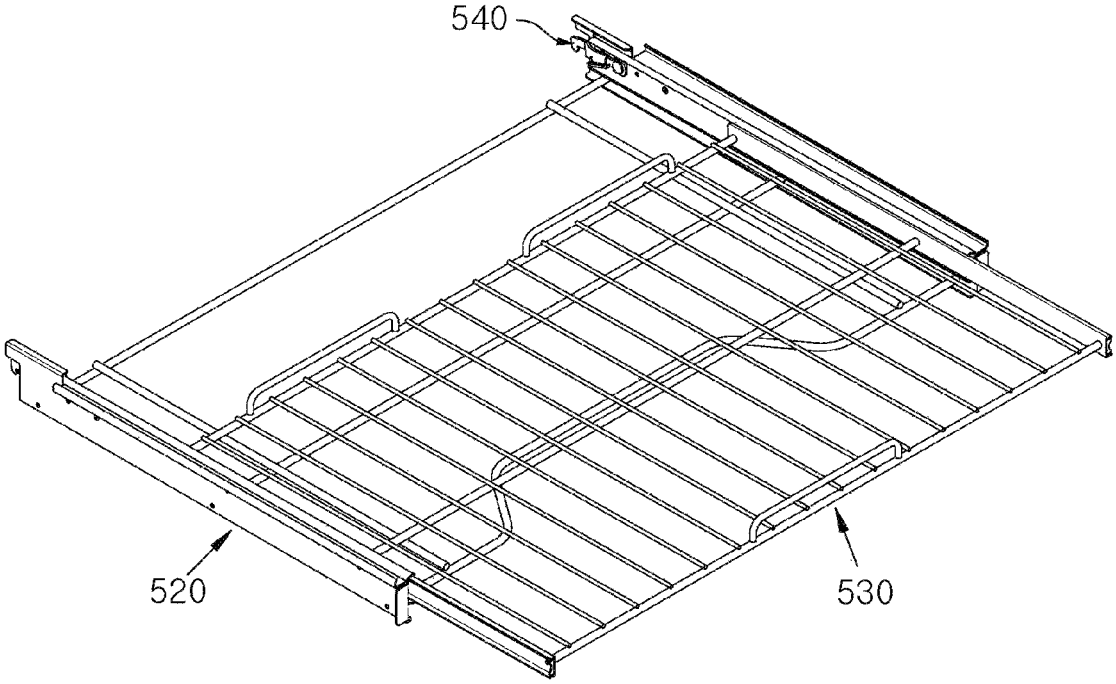
FIG. 2 is a perspective view of a mounting rack and a movable rack of FIG. 1.
Figure 3A:
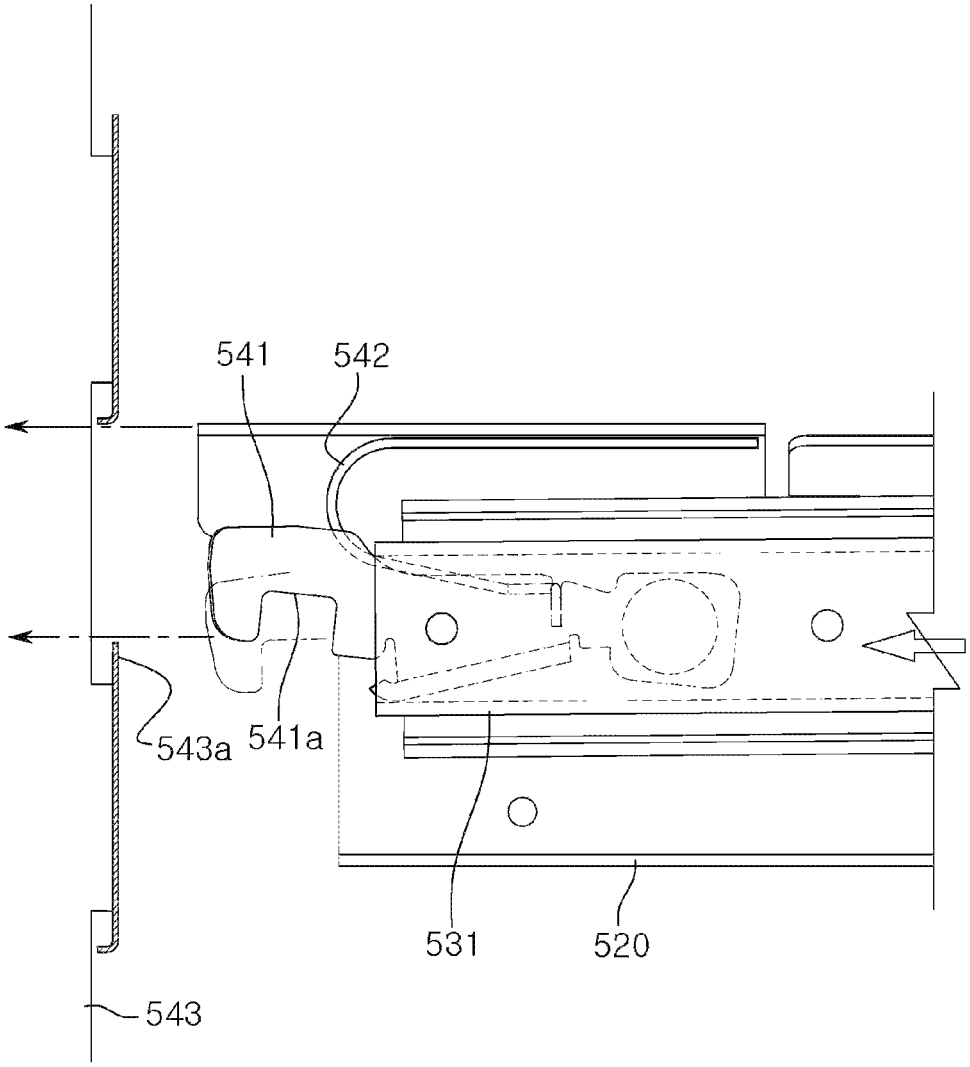
Figure 3B:
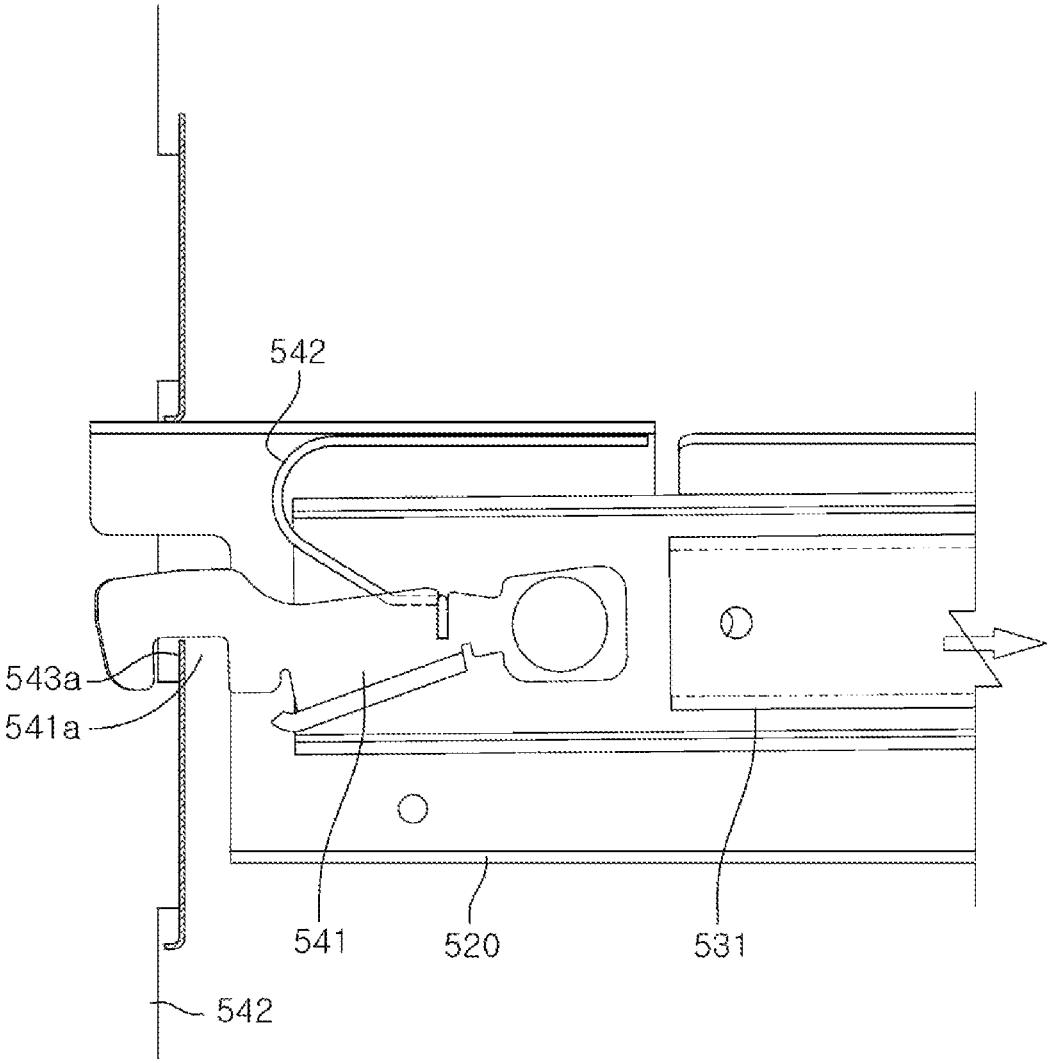
FIG. 3B is a side view of major parts when the movable rack of FIG. 1 is pulled out.

120: mounting rack
130: movable rack
131: glide bracket
140: locking unit
141: locking member
141*b*: inclined operation piece
150: contact cap

DETAILED DESCRIPTION OF THE PREFERRED EMBODIMENT

The present invention will now be described more fully hereinafter with reference to the accompanying drawings, in which the preferred embodiment(s) of the invention is shown so that those of ordinary skill in the art can easily carry out the present invention.

The terms or words to describe the direction of an element (for example, "upward", "downward", "forward" and "backward", among others) are used based on the drawings.

Figure 4:
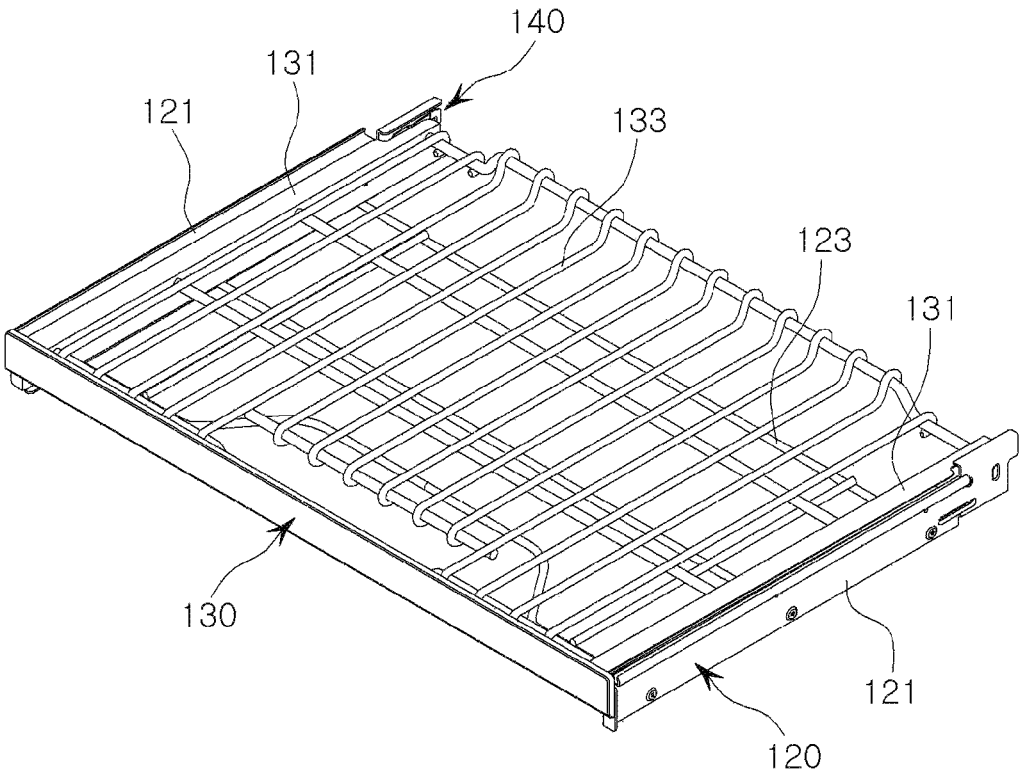
FIG. 4 is a perspective view of a mounting rack and a movable rack with a slide device according to an embodiment of the present invention.
Figure 5:
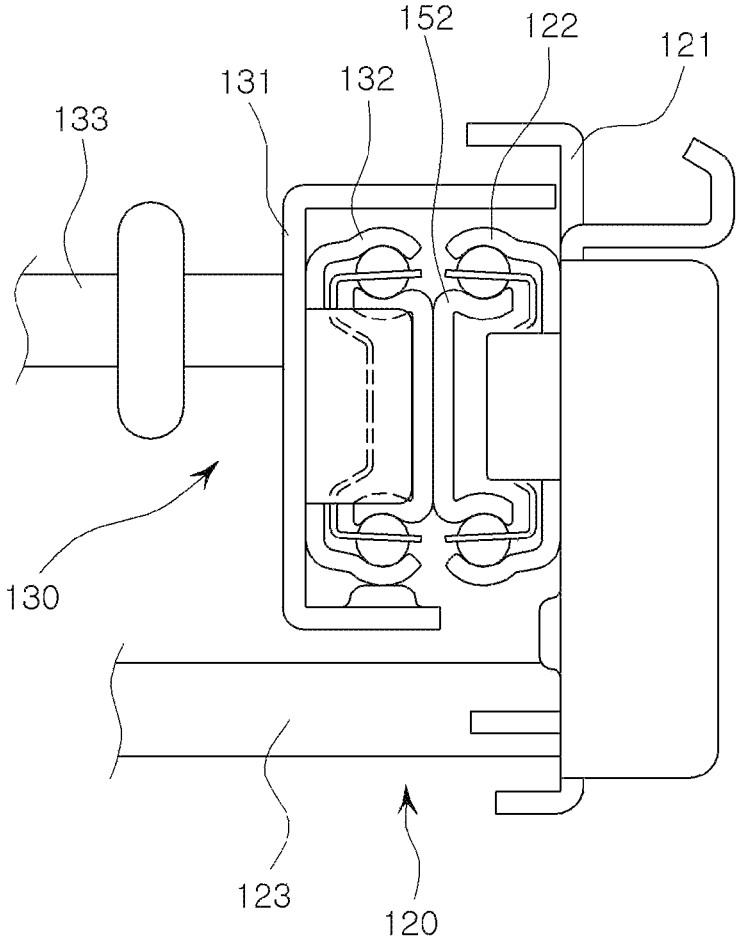
FIG. 5 is a front view of major parts of the mounting rack and the movable rack with the slide device according to the embodiment of the present invention.
Figure 6:
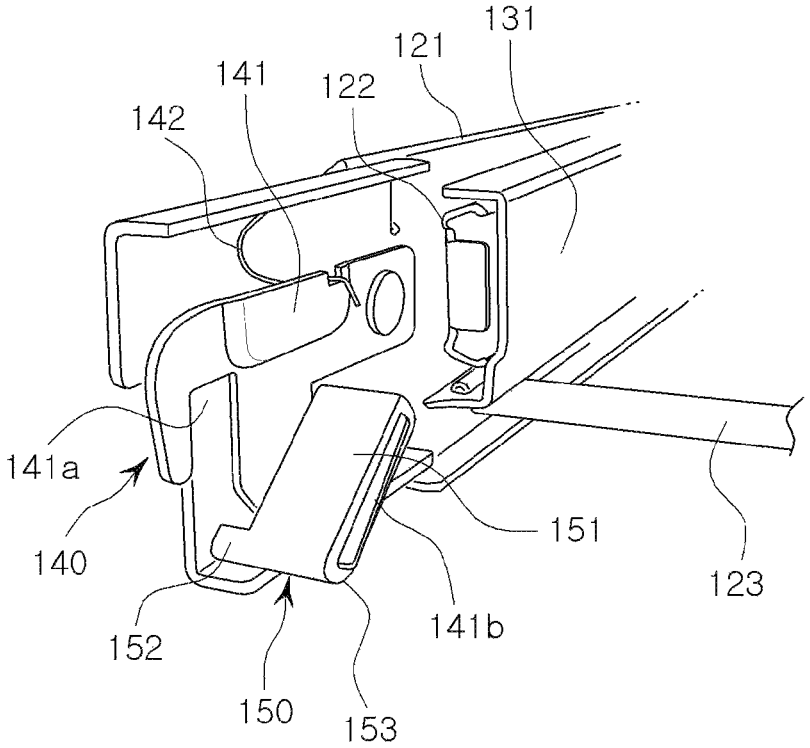
FIG. 6 is a perspective view of the major parts of the mounting rack and the movable rack with the slide device according to the embodiment of the present invention.
Figure 7:
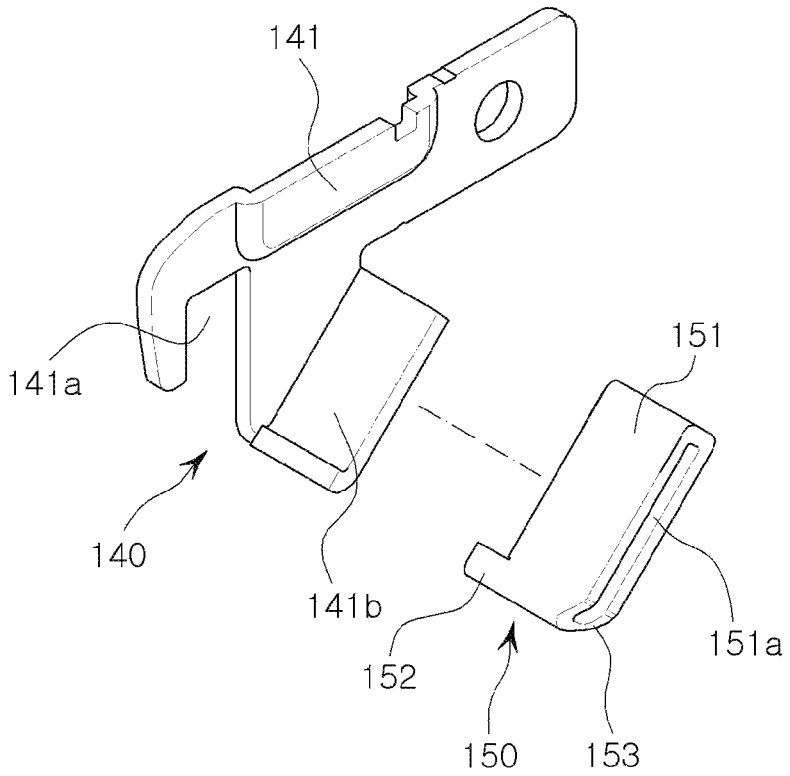
FIG. 7 is an exploded perspective view of a locking member and a contact cap of the slide device according to the embodiment of the present invention.

FIG. 4 is a perspective view of a mounting rack and a movable rack using a slide device for a movable rack according to a preferred embodiment of the present invention, FIG. 5 is a front view of major parts of the mounting rack and the movable rack with the slide device, FIG. 6 is a perspective view of the mounting rack and the movable rack with the slide device, and FIG. 7 is an exploded perspective view of a locking member and a contact cap.

The slide device for a movable rack according to the preferred embodiment of the present invention comprises a machine body, a mounting rack 120, a movable rack 130, a locking unit 140 and a contact cap 150. The machine body includes storage space to receive articles to be cooked or to be washed. The storage space has an open front and both sides on which a plurality of mounting rail grooves are formed.

The mounting rack 120 supports the movable rack 130 to be pulled/pushed in both a forward/backward direction. The mounting rack 120 is removably positioned at any one of the mounting rail grooves formed in the storage space of the machine body.

The mounting rack 120 comprises: a pair of mounting brackets 121 to be movable in the forward/backward direction at the mounting rail grooves 111 in the storage space; a fixing rail member 122 to be fixed to an inner side of each of the mounting bracket 121; and a plurality of mounting grates 123 to be positioned between the pair of mounting brackets 121.

Articles to be kept in the storage space (S) are loaded to the movable rack 130. The movable rack slides in the forward/backward direction in the mounting rack 120 to be pulled out/pushed into the mounting rack 120.

The movable rack 130 comprises: a pair of glide brackets 131; a moving rail member 132 to be fixed to the outside of each of the glide brackets 131; and a plurality of glide grates 133 to be positioned between the pair of the moving rail members 131.

Each of the moving rail members 132 of the movable rack 130 is connected to the fixing rail member 122 of the mounting rack 120 through a middle rail member 152 so that the moving rail member 132 slides in the forward/backward direction.

The locking unit 140 is positioned at the rear inside the mounting bracket 121 of the mounting rack 120, to lock the mounting rack 130 to prevent it from moving when the movable rack 130 is pulled out from the mounting rack 130.

The locking unit 140 comprises a locking member 141 and a spring 142. The locking member 141 includes a front vertically pivotably connected to the mounting bracket 121 by a hinge, a rear lower end having a locking groove 141*a*, and a middle lower part having an inclined operation piece 141*b*. The spring 142 is positioned between the locking member 141 and the mounting bracket 121, to elastically support the locking member 141.

The contact cap 150 is to reduce any operation noise generated when the glide bracket 131 hits the locking member 141 when the movable rack 130 is pushed into the mounting rack 120. The contact cap 150 receives the inclined operation piece 141*b* of the locking member 141.

Preferably, the contact cap 150 is made of Teflon resin materials, such as polytetrafluoroehylene which is very excellent in heat-resistance, chemical resistance, cold temperature-resistance, electric insulation and high frequency properties, etc. and which has superior operatonal univisous properties and low friction properties.

In the contact cap 150, a contact part 152 protrudes to a side of a lower end of an cover part 151 with an insertion hole 151*a*, and a curved surface 153 is formed at an inside of the lower end for a smooth contact with the glide bracket 131.

In the slide device for a movable rack according to the embodiment of the present invention, the mounting rack 120 is placed at any one of the mounting rail grooves formed along the both sides inside the storage space of the machine body, to slide in the forward/backward direction. The position of the mounting rack 120 can be varied vertically by pulling out the mounting rack 120, which was placed at the one mounting rail, to the outside and placing it at another mounting rail.

In the slide device according to the embodiment of the present invention, the movable rack 130 is placed at the mounting rack 120, to slide in the forward/backward direction such that the articles are loaded to/unloaded from the movable rack 120.

In the slide device according to the embodiment of the present invention, the locking unit 140 secures the movable rack 130 such that the mounting rack 120 is prevented from being pulled together with the movable rack 130 when the movable rack 130 is pulled out.

Figure 8A:
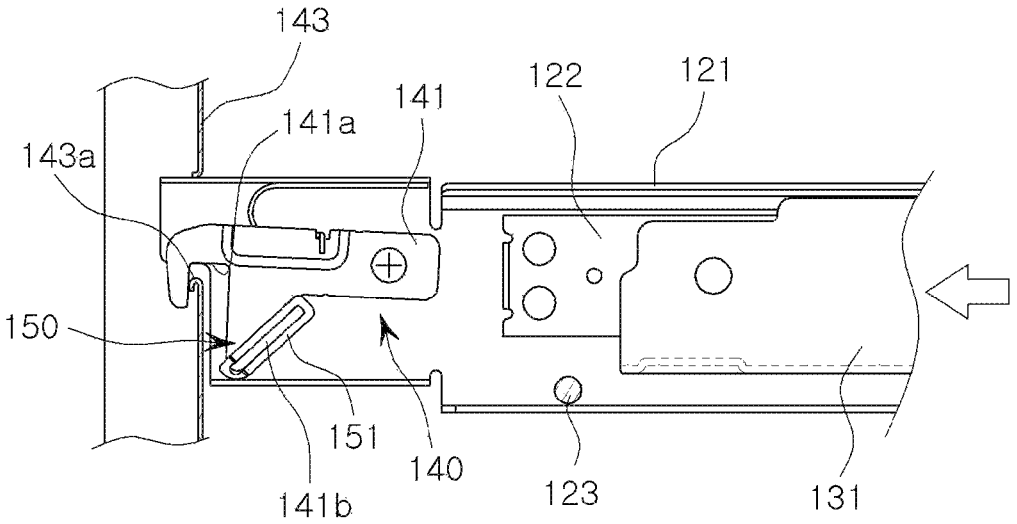
FIGS. 8A and 8B are side views of major parts in the state that the movable rack is pushed/pulled by the slide device for a storage apparatus according to the embodiment of the present invention.
Figure 8B:
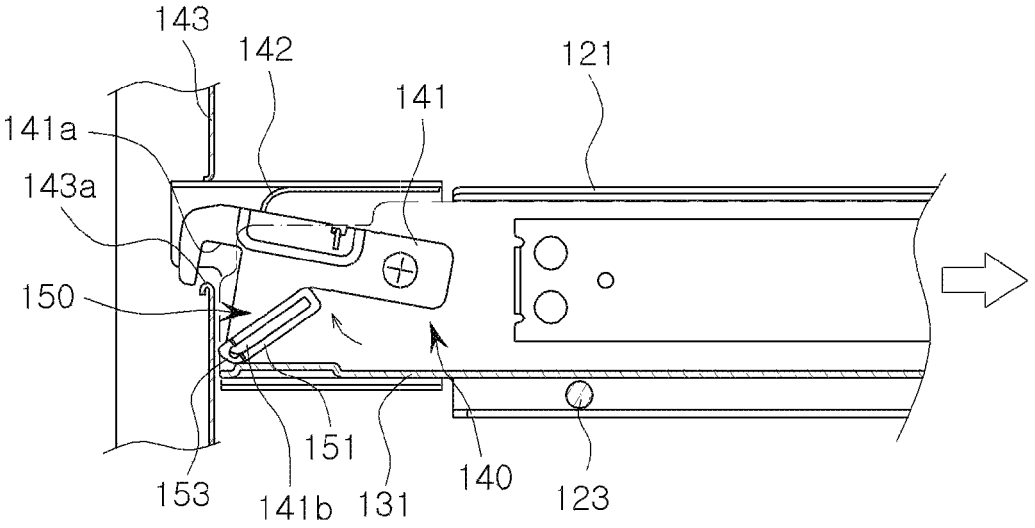

FIGS. 8A and 8B are side views of major parts in the state that the movable rack is pulled out/pushed in.

In the slide device according to the embodiment of the present invention, when the movable rack 130 is pulled out from the mounting rack 120 positioned in the storage space of the machine body, since a rear of the locking member 141 maintains in a downwardly pivoted state through the elasticity of the spring 142 as shown in FIG. 8A, the locking groove 141*a* of the locking member 141 receives the locking piece 143*a* of the locking bracket 143 to be connected together and the mounting rack 120 is locked, so that the mounting rack 120 is prevented from moving when the movable rack 130 is pulled out/pushed in.

When the movable rack 130, which has been pulled out, is pushed into the mounting rack 120, since the rear end of the glide bracket 131 of the movable rack 130 is in contact with the contact cap 150 receiving the inclined operation piece 141*b* of the locking member 141 and then pushes up the inclined operation piece 141*b* counterclockwise, the locking member 141 pivots counterclockwise. Accordingly, the locking groove 141*a* of the locking member 141 is separated from the locking piece 143*a* of the locking bracket 143 and thus the locking state of the mounting rack 120 is released, as shown in FIG. 8B.

When the mounting rack 120 is unlocked, the mounting rack 120 and the movable rack 130 are able to be pulled out to the outside of the storage space.

As described above, the slide device for a movable rack according to the embodiment of the present invention locks the mounting rack 120 when pulling out only the movable rack 130 from the storage space of the machine body and unlocks the mounting rack 120 when pushing the movable rack 130 into the mounting rack 120, thereby enabling pulling out the movable rack 130 and the mounting rack 120 from the storage space (S) of the machine body 110.

In the slide device for a movable rack according to the embodiment of the present invention, since the rear end of the glide bracket 131 of the movable rack 130 is in contact with the contact cap 150 receiving the inclined operation piece 141*b* of the locking member 141 when the movable rack 130 is pushed in, the impact and noise generated during pushing the movable rack 130 inside are greatly reduced.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. Simple modifications or similar arrangements of the present invention belong to the category of the invention and therefore, the protection range of the invention will be apparent by the claims attached herewith.

What is claimed is:

1. A slide device comprising:

a movable rack;

a mounting rack configured to be removably positioned at any one of a plurality of mounting rail grooves disposed in a storage space of a machine body and to support the movable rack to move in both a forward direction and a backward direction, wherein the movable rack is configured to move in the forward direction and the backward direction by a sliding motion on the mounting rack, and the movable rack comprises a pair of glide brackets;

a locking unit positioned in a rear inside of the mounting rack and configured to fix the mounting rack to prevent the mounting rack from moving when the movable rack is pulled out from the mounting rack, wherein the locking unit comprises:

a locking member including a front to be connected to the mounting rack by a hinge and configured to pivot upwardly, a rear lower end with a locking groove and a middle lower part with an inclined operation piece; and a spring positioned between the locking member and the mounting rack and configured to elastically support the locking member; and a contact cap configured to receive the inclined operation piece of the locking member, wherein the contact cap comprises:

a cover part with an insertion hole;

a contact part extending at a side of a lower end of the cover part; and a curved surface disposed at an inner side of the lower end and configured to enable a smooth contact with the pair of glide brackets.

2. The slide device according to claim 1, wherein the mounting rack comprises:

a pair of mounting brackets configured to be positioned at the mounting rail grooves in the storage space and to be movable in the forward direction and the backward direction;

a fixing rail member configured to be fixed inside each of the pair of mounting brackets; and a plurality of mounting grates positioned between the pair of the mounting brackets, and wherein the movable rack further comprises:

a pair of moving rail members configured to be fixed to an outside of each of the pair of glide brackets, wherein each of the moving rail members of the movable rack is connected to the fixing rail member of the mounting rack through a middle rail member; and a plurality of glide grates positioned between the pair of the moving rail members.

* * * * *